US010151449B2

(12) United States Patent
Takeshita

(10) Patent No.: US 10,151,449 B2
(45) Date of Patent: Dec. 11, 2018

(54) LIGHTING APPARATUS

(71) Applicant: PANASONIC INTELLECTUAL PROPERTY MANAGEMENT CO., LTD., Osaka (JP)

(72) Inventor: Hironori Takeshita, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/645,150

(22) Filed: Jul. 10, 2017

(65) Prior Publication Data

US 2018/0017233 A1 Jan. 18, 2018

(30) Foreign Application Priority Data

Jul. 12, 2016 (JP) ..... 2016-137649

(51) Int. Cl.

| | |
|---|---|
| ***F21V 11/10*** | (2006.01) |
| ***F21V 13/10*** | (2006.01) |
| ***F21S 10/00*** | (2006.01) |
| ***F21V 3/02*** | (2006.01) |
| ***F21V 7/05*** | (2006.01) |
| ***F21V 11/00*** | (2015.01) |

(Continued)

(52) U.S. Cl.

CPC ..... *F21V 13/10* (2013.01); *F21S 10/00* (2013.01); *F21V 3/02* (2013.01); *F21V 7/0016* (2013.01); *F21V 7/0033* (2013.01); *F21V 7/05* (2013.01); *F21V 11/00* (2013.01); *F21V 19/0015* (2013.01); *H05B 33/0845* (2013.01); *H05B 33/0857* (2013.01); *H05B 37/0272* (2013.01); *F21Y 2103/10* (2016.08); *F21Y 2105/00* (2013.01); *F21Y 2113/13* (2016.08); *F21Y 2115/10* (2016.08)

(58) Field of Classification Search

CPC ..... F21V 7/00; F21V 23/007; F21V 23/023; F21V 23/04; F21V 3/049; F21V 5/004; F21V 7/0008; F21V 7/04; F21V 7/09; G02B 6/0046; G02B 6/0055; G02B 6/0073

USPC ..... 362/611

See application file for complete search history.

(56) References Cited

U.S. PATENT DOCUMENTS 5,957,561 A * 9/1999 Ono ..... G02B 6/0061 362/23.15
6,011,601 A * 1/2000 Kojima ..... G02B 6/0053 349/112

(Continued)

FOREIGN PATENT DOCUMENTS

JP 2007-317659 A 12/2007
JP 2011-053309 A 3/2011

(Continued)

*Primary Examiner* — Thien M Le

(74) *Attorney, Agent, or Firm* — Greenblum & Bernstein, P.L.C.

(57) ABSTRACT

A lighting apparatus includes: a light source; a reflector plate which reflects light; and a diffuser plate which is light transmissive and is disposed to face the reflector plate. A gap between the diffuser plate and the reflector plate gradually decreases from a lower portion side of the diffuser plate and the reflector plate to an upper potion side of the diffuser plate and the reflector plate. The light source is disposed on the lower portion side to emit light toward the diffuser plate and the reflector plate.

13 Claims, 5 Drawing Sheets

(51) Int. Cl.

| | |
|---|---|
| ***F21V 19/00*** | (2006.01) |
| ***H05B 33/08*** | (2006.01) |
| ***H05B 37/02*** | (2006.01) |
| ***F21V 7/00*** | (2006.01) |
| *F21Y 115/10* | (2016.01) |
| *F21Y 105/00* | (2016.01) |
| *F21Y 103/10* | (2016.01) |
| *F21Y 113/13* | (2016.01) |

(56) References Cited

U.S. PATENT DOCUMENTS

| | | | | |
|---|---|---|---|---|
| 8,847,251 | B2 | 9/2014 | Sugiura et al. | |
| 2007/0274096 | A1 | 11/2007 | Chew et al. | |
| 2008/0158641 | A1* | 7/2008 | Lieb | G02B 6/0046 359/263 |
| 2009/0201447 | A1* | 8/2009 | Zhuang | G02F 1/13306 349/97 |
| 2011/0051036 | A1 | 3/2011 | Yamashita et al. | |
| 2011/0267800 | A1* | 11/2011 | Tong | F21V 3/02 362/84 |
| 2015/0378083 | A1 | 12/2015 | Takakusaki | |
| 2018/0084924 | A1* | 3/2018 | Sun | A47F 3/001 |

FOREIGN PATENT DOCUMENTS

| | | | |
|---|---|---|---|
| JP | 2011-054312 | A | 3/2011 |
| JP | 2012-221553 | A | 11/2012 |
| JP | 2015-191686 | A | 11/2015 |
| JP | 2016-012540 | A | 1/2016 |

* cited by examiner

LIGHTING APPARATUS

CROSS REFERENCE TO RELATED APPLICATION

This application claims the benefit of priority of Japanese Patent Application Number 2016-137649 filed on Jul. 12, 2016, the entire content of which is hereby incorporated by reference.

BACKGROUND

1. Technical Field

The present disclosure relates to a lighting apparatus capable of emitting light imitating the sky in nature, and performing illumination rendering for providing a sense of infinite depth as if viewing the distant sky.

2. Description of the Related Art

Conventionally, a planar lighting apparatus which includes a light source for emitting white light, a reflection sheet for reflecting light, and a light guide plate has been disclosed (see, for example, Japanese Unexamined Patent Application Publication No. 2016-12540).

The planar lighting apparatus is capable of suppressing color unevenness occurring on the light guide plate and uniforming color tones of emission light.

SUMMARY

However, when the lighting apparatus is installed on a wall, a ceiling, or the like in facilities, it is difficult to reproduce a blue sky by the lighting apparatus, because a color temperature or a luminance level is uniform. In addition, it is conceivable that a display of a television set, for example, is installed in facilities for reproducing a blue sky. However, with a video display device such as a display, a position of the surface of a light emitter is easily and precisely recognized physically, due to granularity of image elements or the like, and thus it is difficult to reproduce a sky that is recognizes as the sky in nature.

In view of the above, an object of the present disclosure is to provide a lighting apparatus capable of reproducing an artificial sky with a simple configuration.

In order to achieve the above-described object, a lighting apparatus according to an aspect of the present disclosure includes: a light source; a reflector plate which reflects light; and a diffuser plate which is light transmissive and is disposed to face the reflector plate, wherein a gap between the diffuser plate and the reflector plate gradually decreases from one end side of the diffuser plate and the reflector plate to the other end side of the diffuser plate and the reflector plate, and the light source is disposed on the one end side to emit light toward the diffuser plate and the reflector plate.

According to the present disclosure, it is possible to reproduce an artificial sky with a simple configuration.

BRIEF DESCRIPTION OF DRAWINGS

The figures depict one or more implementations in accordance with the present teaching, by way of examples only, not by way of limitations. In the figures, like reference numerals refer to the same or similar elements.

Figure 1:
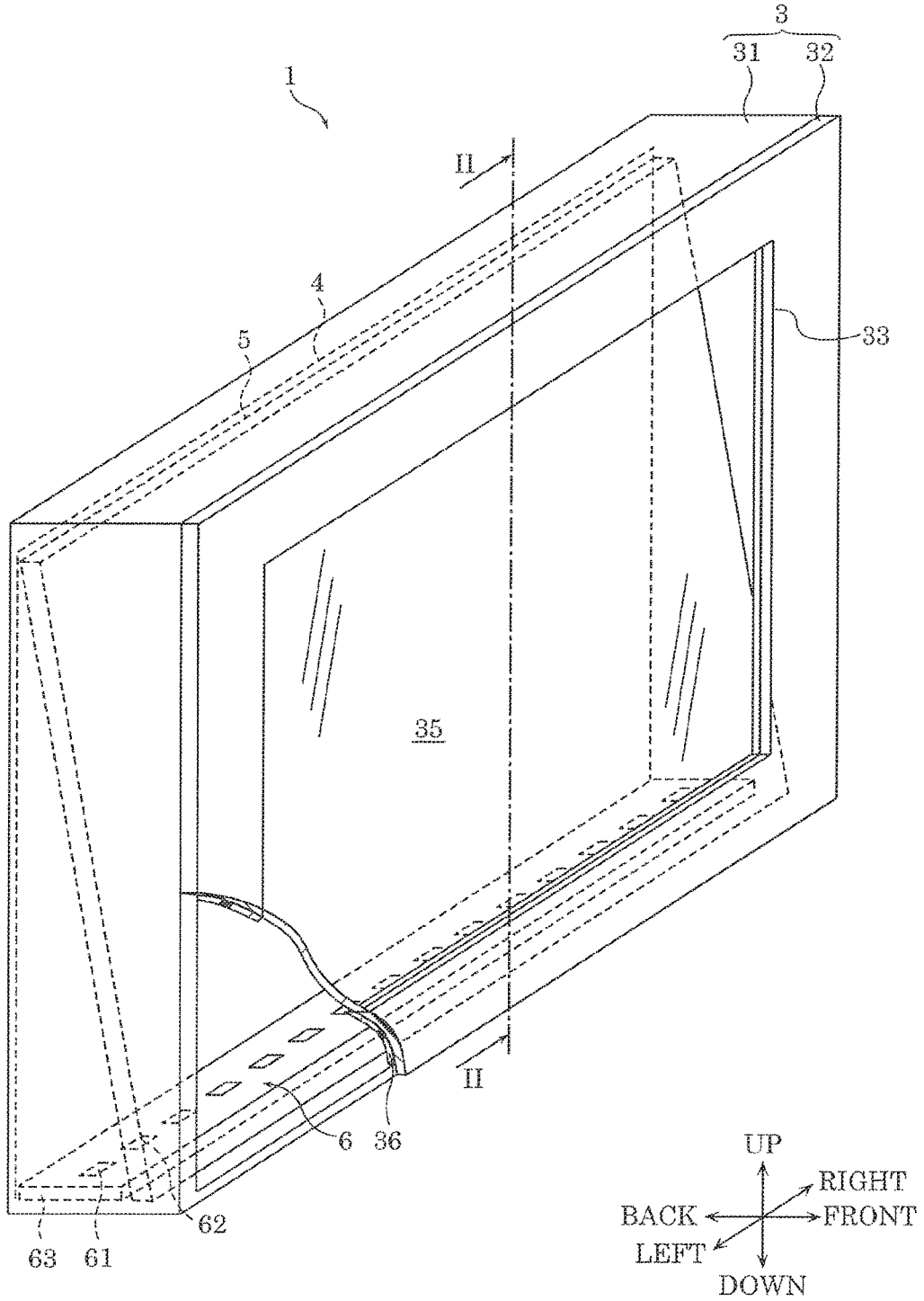
FIG. 1 is a perspective view which illustrates the lighting apparatus according to Embodiment 1.

DETAILED DESCRIPTION OF THE EMBODIMENTS (Underlying Knowledge Forming the Basis of the Present Disclosure)

When viewing a blue sky through a window from the inside of a room, the viewer feels a sense of infinite depth present behind the window. In addition, a blue sky is not uniform but consecutively changes gradationally in a color temperature or a luminance level. Furthermore, light entering through a window changes in the color temperature with passage of time during the day and according to the weather. For that reason, when a lighting environment is provided using a lighting apparatus, how to provide a lighting environment which is more similar to the lighting environment in nature matters.

When a generally-used lighting apparatus is used for setting a lighting environment similar to the lighting environment in nature, the lighting apparatus emits uniform light with luminance unevenness and color unevenness being suppressed, and it is difficult to feel a sense of depth as if viewing an actual sky. Accordingly, a cooped-up feeling is still sensed even when the generally-used lighting apparatus is installed on a ceiling, a wall, or the like.

In facilities or the like where it is difficult to obtain natural light from the architectural point of view, it is possible, for example, to provide a user with a sense of openness or to make a user feel relaxed with the sense of openness, by setting a lighting environment similar to the lighting environment in nature. In addition, bright light contributes to a better external appearance, and thus there is demand for aggressively introducing light into the facilities, for example.

In view of the above, it is conceivable that a display of a television set, or the like, is installed in facilities for reproducing a blue sky. However, with the display or the like, a physical position of a video display surface is easily and precisely recognized, and it is difficult to reproduce light entering through a window, making it difficult to feel the display or the like as if an actual window. In addition, with restriction on a weight, it may be difficult to install the display or the like on a wall or a ceiling in facilities, and thus it is conceivable that construction costs for the installation are increased.

In view of the above, there is demand for providing a lighting environment which provides a feeling as if a window is present in a place where a window cannot be normally installed. In other words, a bright and relaxing openness is created, for example, by installing a lighting apparatus which provides a natural lighting environment and a sense of infinite depth as if viewing a blue sky through a window. In addition, in terms of costs, there is also demand for suppressing an increase in costs for installation.

In view of the above, an object of the present disclosure is to provide a lighting apparatus capable of reproducing an artificial sky with a simple configuration.

Hereinafter, embodiments of the present disclosure will be described with reference to the drawings. It should be noted that the subsequently-described embodiments each show a specific example of the present disclosure. Therefore, numerical values, shapes, materials, structural components, the arrangement and connection of the structural components, etc. shown in the following embodiments are mere examples, and are not intended to limit the scope of the present disclosure. Furthermore, among the structural components in the following embodiments, components not recited in the independent claim which indicates the broadest concept of the present disclosure are described as arbitrary structural components.

Moreover, "substantially" and "approximately" mean, for example in the case of "substantially the same", not only exactly the same, but what would be recognized as essentially the same as well.

In addition, each of the diagrams is a schematic diagram and thus is not necessarily strictly illustrated. In each of the diagrams, substantially the same structural components are assigned with the same reference signs, and redundant descriptions will be omitted or simplified.

Embodiment 1

The following describes a lighting apparatus according to Embodiment 1 of the present disclosure.

(Configuration)

First, a configuration of lighting apparatus 1 according to the present embodiment shall be described with reference to FIG. 1.

Figure 2:
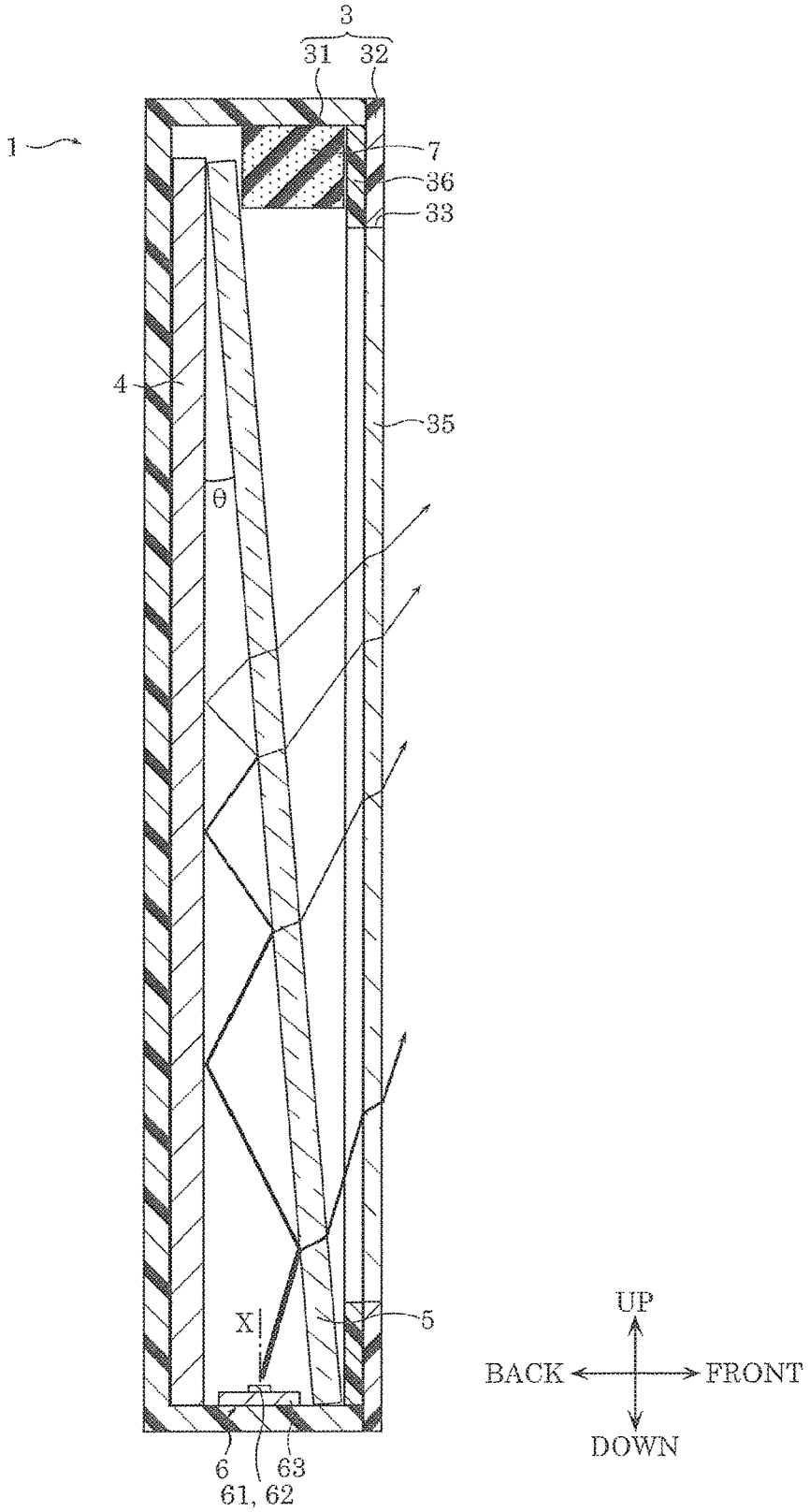
FIG. 2 is a cross-sectional view which illustrates the lighting apparatus along the line II-II of FIG. 1, according to Embodiment 1.
Figure 3:
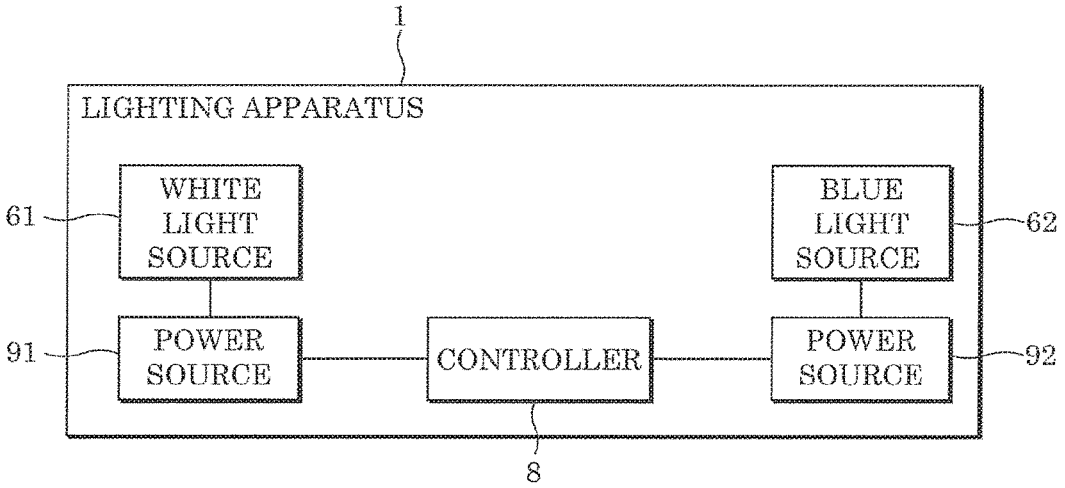
FIG. 3 is a block diagram which the illustrates the lighting apparatus according to Embodiment 1.

FIG. 1 is a perspective view which illustrates lighting apparatus 1 according to Embodiment 1. FIG. 2 is a cross-sectional view which illustrates lighting apparatus 1 along the line II-II of FIG. 1, according to Embodiment 1. FIG. 3 is a block diagram which illustrates lighting apparatus 1 according to Embodiment 1.

In FIG. 1, the directions of front, back, left, right, up, and down are shown, where the direction from the center of lighting apparatus 1 toward light-transmissive plate 35 is defined as a front direction, and the direction from the center of lighting apparatus 1 toward first light emitting module 6 is defined as a down direction. It should be noted that the directions illustrated in FIG. 2 and subsequent figures correspond to those illustrated in FIG. 1. It should also be noted that the up and down directions, right and left directions, and front and back directions illustrated in FIG. 1 may change depending on how the lighting apparatus is used, and as such, are non-limiting examples. The same applies to all subsequent figures.

As illustrated in FIG. 1 to FIG. 3, lighting apparatus 1 includes casing 3, reflector plate 4, diffuser plate 5, first light emitting module 6, eaves portion 7, controller 8, and two power sources 91 and 92.

Casing 3 is a box which is thin in the front and back directions, and houses reflector plate 4, diffuser plate 5, first light emitting module 6, controller 8, and two power sources 91 and 92. Casing 3 according to the present embodiment has a rectangular shape which is elongated in the right and left direction in a front view (viewed from a front surface).

Casing 3 includes main body 31 and frame body 32.

Main body 31 is a box which is thin in the front and back directions and has a bottom and a front that is fully open. Main body 31 houses reflector plate 4, diffuser plate 5, first light emitting module 6, eaves portion 7, and two power sources 91 and 92.

Frame body 32 is a flat component having a rectangular shape in a front view. Frame body 32 has opening portion 33 having a rectangular shape, in a center portion. Opening portion 33 corresponds to an inner portion of frame body 32. Frame body 32 is disposed in front of main body 31. In other words, frame body 32 is disposed to cover an outer periphery of diffuser plate 5 in a front view of opening portion 33. Opening portion 33 of frame body 32 is provided with light-transmissive plate 35 to cover opening portion 33.

Frame body 32 includes a back surface having a black color which suppresses reflection of light. According to the present embodiment, frame body 32 includes light absorbing sheet 36 (an example of an antireflection film) which has a black color that absorbs light. Light absorbing sheet 36 is disposed on the back surface of frame body 32, and suppresses reflection of light emitted from diffuser plate 5 at frame body 32. In addition, according to the present embodiment, light absorbing sheet 36 is disposed uniformly on the back surface of frame body 32, other than a portion at which frame body 32 and main body 31 are in contact with each other. In other words, an opening portion that corresponds to opening portion 33 is formed in light absorbing sheet 36.

It should be noted that light absorbing sheet 36 is disposed for the purpose of preventing reflection of light toward diffuser plate 5, and thus the color of light absorbing sheet 36 is not limited to black, as long as light absorbing sheet 36 has the function of preventing reflection of light toward diffuser plate 5.

In addition, frame body 32 may be designed imitating a window frame so as to provide sensation as if light is entering through a window.

Opening portion 33 in frame body 32 has an inner circumference surface which has a black color that suppresses reflection of light. As one example of providing the black color to the inner circumference surface of opening portion 33, a light absorbing sheet (an example of an antireflection film) which prevents reflection of light may cover the inner circumference surface of opening portion 33. The light absorbing sheet may be disposed between light-transmissive plate 35 and opening portion 33, or may be a component similar to light absorbing sheet 36.

Light-transmissive plate 35 is a flat component and is light transmissive. Light-transmissive plate 35 is fixed to frame body 32 to cover opening portion 33 of frame body 32. Light-transmissive plate 35 is formed using a light-transmissive resin material such as acrylic and polycarbonate, or a light-transmissive material such as a transparent glass material.

Light-transmissive plate 35 has at least one surface uniformly covered by an antireflection film or an antireflection material for preventing reflection of light. With lighting apparatus 1, the antireflection film or the antireflection material covers the back surface of light-transmissive plate 35, to make it difficult for light to be reflected.

The antireflection material or the antireflection film according to the present embodiment can be formed as a coating film, for example, through nanopatterning or the like. It should be noted that the antireflection material and the antireflection film are not limited to the above-described examples. In addition, various types of antireflection materials and antireflection films may be used, and the antireflection material or the antireflection film may be formed using a technique known in the art.

Reflector plate 4 is a flat component having a rectangular shape in a front view, and is a mirror which reflects incident light. It should be noted that reflector plate 4 only need to reflect incident light, and may be, for example, a plate which is black in color. Reflector plate 4 is housed in main body 31 such that reflector plate 4 is substantially parallel with a base portion (back surface) of main body 31, and has a front surface which is the mirror faces forward. Reflector plate 4 reflects light directly incident on reflector plate 4 from white light source 61 and blue light source 62 which will be described later, and light incident on diffuser plate 5 from white light source 61 and blue light source 62 and diffused.

Reflector plate 4 has a wavelength-selective property of absorbing red light and reflecting blue light. Reflector plate 4 is implemented by applying, to the surface of reflector plate 4, a light diffusion reflection sheet having a property of diffusely reflecting light. Here, red light is light having a wavelength in a range from 610 nm or greater to 750 nm or less, and not strictly meaning red, but meaning light generally looks red. In addition, here, blue light is light having a wavelength in a range from 435 nm or greater to 495 nm or less and not strictly meaning blue, but meaning light generally looks blue.

Reflector plate 4 diffusely reflects less than or equal to 50% of incident light (i.e., of all of reflected light). It should be noted that reflector plate 4 may have functions of specular reflection and diffuse reflection which are partially combined. In addition, of all of reflected light that is reflected by reflector plate 4, the percentage of light diffusely reflected may be only small, and the percentage of light diffusely reflected may be 0%. Here, diffuse reflection means to reflect incident light in various directions when light is incident on reflector plate 4 at a certain incident angle, and also referred to as irregular reflection. Furthermore, when light is incident on reflector plate 4 at a certain incident angle, specular reflection, here, means to reflect the light at an angle substantially equal to the incident angle of the light, in a direction that depends on the incident angle of the light.

It should be noted that reflector plate 4 may have a property that reflects light intensively forward (in a desired direction) irrespective of an incident angle of the light. This can be achieved by, for example, providing an uneven shape to the front surface of reflector plate 4.

Reflector plate 4 is implemented by, for example, mirror finishing applied through mirror coating or polishing, a fine optical structure, an anisotropic material, etc. In addition, reflector plate 4 may be, for example, a mirror including metal such as aluminum or silver vapor that is deposited on a component such as resin, rubber, or metal.

Diffuser plate 5 is a component having a rectangular shape in a front view, and disposed on main body 31 such that diffuser plate 5 faces reflector plate 4 on a front side of reflector plate 4. In addition, diffuser plate 5 is disposed in such a manner that at least a portion of a surface of diffuser plate 5 is slanted at a predetermined angle θ to reflector plate 4. The gap between diffuser plate 5 and reflector plate 4 gradually decreases from a lower portion side (an example of one end side) of diffuser plate 5 and reflector plate 4 to an upper portion side (an example of the other end side) of diffuser plate 5 and reflector plate 4. Here, the predetermined angle θ is in a range from 2 degrees or greater to 10 degrees or less. According to the present disclosure, the predetermined angle θ formed by diffuser plate 5 and reflector plate 4 is 5 degrees.

Diffuser plate 5 has a light diffusion function for diffusing light. Diffuser plate 5 includes, as a base material, resin such as light-transmissive acrylic. It should be noted that, as one example of diffuser plate 5, a Rayleigh diffuser plate which causes Rayleigh scattering of incident light may be employed. The Rayleigh diffuser plate is a component which includes resin such as light-transmissive acrylic as a base material, and a nanocomposite material dispersed therein. The nanocomposite material is oxidized metal such as titanium oxide, zinc oxide, zirconia oxide, etc. When a particle size of the nanocomposite material is sufficiently smaller than a wavelength of light, Rayleigh scattering of light which is incident on diffuser plate 5 occurs.

First light emitting module 6 emits light of different luminescent colors. More specifically, first light emitting module 6 is a module which includes a plurality of white light sources 61 (an example of the light source), a plurality of blue light sources 62 (an example of the light source), and circuit board 63 on which the plurality of white light sources 61 and the plurality of blue light sources 62 are mounted. First light emitting module 6 has a plate-like shape which is elongated in the left and right directions, and is disposed between reflector plate 4 and diffuser plate 5 on a lower side of reflector plate 4 and diffuser plate 5. In other words, first light emitting module 6 is disposed in such a manner that optical axis X of the light source is sandwiched between reflector plate 4 and diffuser plate 5. It should be noted that, in the present embodiment, the light source refers to the plurality of white light sources 61 and the plurality of blue light sources 62.

The plurality of white light sources 61 and the plurality of blue light sources 62 are, as they are called, surface mount device (SMD) light emitting diode (LED) elements. Specifically, the SMD LED element is an LED element of a package-type formed by mounting an LED chip (light-emitting element) in a cavity molded by resin, and disposing a phosphor-containing resin in the cavity. The plurality of white light sources 61 and the plurality of blue light sources 62 are turned on, dimmed, and turned off under the control of controller 8 disposed in lighting apparatus 1. In addition, the plurality of white light sources 61 and the plurality of blue light sources 62 receive dimming control and toning control as a result of controller 8 separately or simultaneously controlling, by adjusting the amount of power supply, the two power sources 91 and 92. According to the present embodiment, dimming (brightness) and toning (a luminescent color of emitted light) of first light emitting module 6 may be controlled.

It should be noted that the plurality of white light sources 61 and the plurality of blue light sources 62 are not limited to the above-described configuration, and a chip on board (COB) module including an LED chip directly mounted on circuit board 63 may be used. In addition, the light-emitting element included by the plurality of white light sources 61 and the plurality of blue light sources 62 is not limited to an LED, and may be, for example, a semiconductor light-emitting element such as a semiconductor laser, or a solid-state light-emitting element such as an organic electro luminescence (EL) or an inorganic EL.

The plurality of white light sources 61 and the plurality of blue light sources 62 may be disposed at substantially regular intervals along the length (the right and left directions) of circuit board 63, and may be disposed such that white light source 61 and blue light source 62 are alternately disposed in a line in the right and left directions.

Optical axis X of each of the plurality of white light sources 61 and optical axis X of each of the plurality of blue light sources 62 extend upwardly between reflector plate 4 and diffuser plate 5. According to the present embodiment, diffuser plate 5 is present above optical axis X of each of the plurality of white light sources 61 and above optical axis X of each of the plurality of blue light sources 62. In addition, according to the present embodiment, optical axis X of each of the plurality of white light sources 61 and optical axis X of each of the plurality of blue light sources 62 are substantially parallel with reflector plate 4.

Controller 8 controls operations of first light emitting module 6, such as turning on, turning off, dimming (adjustment of brightness), and toning (adjustment of a luminescent color of emitted light (color temperature)), according to an instruction issued by a user (a control signal transmitted via a remote controller or the like). Controller 8 includes a circuit, etc., for controlling first light emitting module 6 Controller 8 implements the above-described operations by a microcomputer, processor, etc., or a dedicated circuit, which control a value of a current supplied to first light emitting module 6 according to an input signal.

The two power sources 91 and 92 each includes a power supply circuit which generates power for causing first light emitting module 6 to emit light. The two power sources 91 and 92 each rectifies, smoothes, steps down, etc., power supplied from a power system, for example, to convert the power into DC power at a predetermined level, and supplies the DC power to first light emitting module 6. The two power sources 91 and 92 are electrically connected to the power system via power lines such as control lines.

Power source 91 which is one of the two power sources 91 and 92 supplies power to each of white light sources 61, and power source 92 which is the other of the two power sources 91 and 92 supplies power to each of blue light sources 62. The two power sources 91 and 92 switches on and off power supply to first light emitting module 6, as a result of being controlled by a control circuit. For example, when lighting apparatus 1 receives an operation for turning on via an operation component such as a remote controller, the control circuit causes the two power sources 91 and 92 to supply power to first light emitting module 6 to turn on white light sources 61 and blue light sources 62. When lighting apparatus 1 receives an operation for turning off via the operation component, the control circuit causes the two power sources 91 and 92 to stop supplying power to first light emitting module 6 to turn off white light sources 61 and blue light sources 62.

Eaves portion 7 is mounted on an upper portion of main body 31.

Eaves portion 7 is disposed on the upper portion side of diffuser plate 5 and reflector plate 4, in front of a front surface of diffuser plate 5 through which light exits (on a light-exit side). It should be noted that eaves portion 7 may have a portion (a rear end side) positioned behind diffuser plate 5. According to the present embodiment, eaves portion 7 is a component which is black in color that suppresses reflection of light, and fixed to an upper-side wall of main body 31.

It should be noted that, although eaves portion 7 is separately provided in casing 3, the upper portion of main body 31 may serve as eaves portion 7. In this case, the upper-side wall of main body 31 may have a bottom surface which is black in color that suppresses reflection of light, or may be uniformly provided with light absorbing sheet 36 in the same manner as frame body 32.

With lighting apparatus 1 described above, for example, light emitted from white light source 61 or blue light source 62 is partially reflected by a back surface of diffuser plate 5 and travels to reflector plate 4, and partially passes through diffuser plate 5 and exits through the front surface of diffuser plate 5. Light which is incident on reflector plate 4 having the wavelength-selective property behaves differently. Specifically, red light, etc., which has a low color temperature is absorbed by reflector plate 4, and blue light, etc., which has a high color temperature is diffusely reflected by reflector plate 4. Furthermore, blue light diffusely reflected by reflector plate 4 is incident on the back surface of diffuser plate 5, and then partially passes through diffuser plate 5 and exits through the front surface of diffuser plate 5, or partially reflected by the back surface of diffuser plate 5 and further diffusely reflected by reflector plate 4. In this manner, light exits through diffuser plate 5 while repeatedly being reflected and diffused, and thus light having a high luminance level is emitted from a lower portion side of diffuser plate 5 (portion close to light emitting module 6), and light having a low luminance level is emitted from an upper portion side of diffuser plate 5 In other words, the luminance level of light emitted from diffuser plate 5 increases with decreasing distance from the light source, and decreases with increasing distance from the light source. In such a manner, light which provides a sense of a color and a luminance gradient which are similar to the actual sky is emitted from diffuser plate 5.

Figure 4:
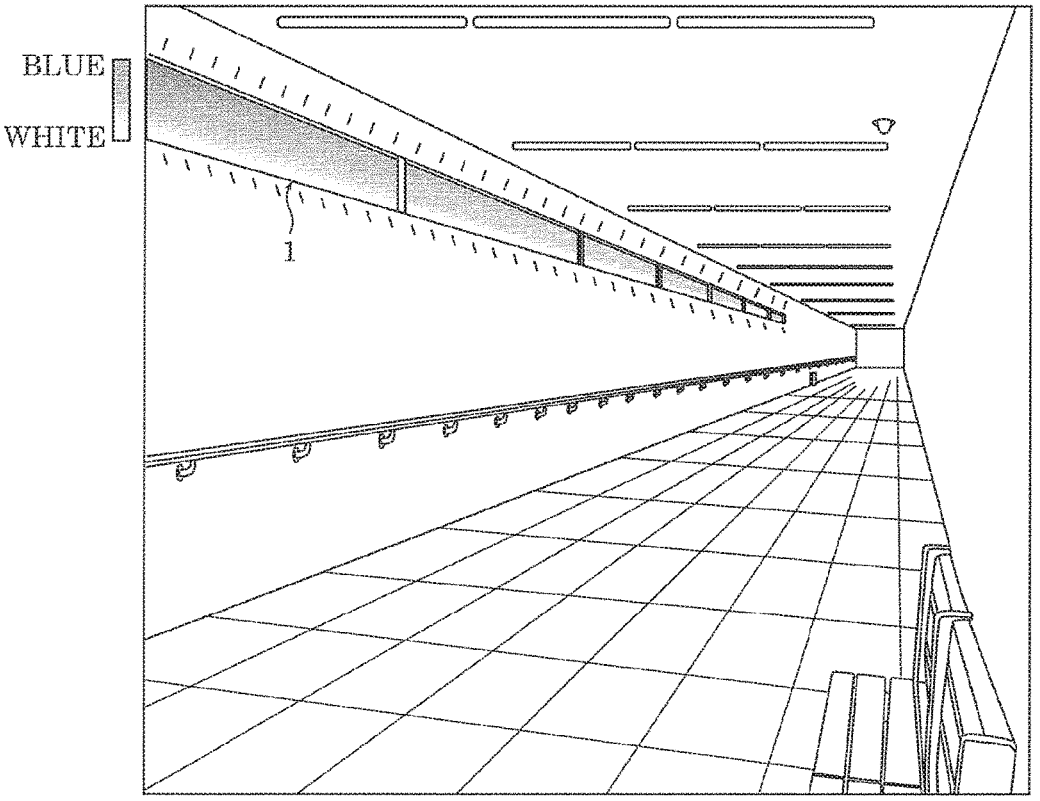
FIG. 4 is an image view which illustrates a state in which the lighting apparatus according to Embodiment 1 is used.

FIG. 4 is an image view which illustrates a state in which lighting apparatus 1 according to Embodiment 1 is used.

As illustrated in FIG. 4, lighting apparatus 1 is installed in a facility (location) etc., where natural lighting is difficult to obtain. Lighting apparatus 1, for example, may be disposed above an eye level (horizontal direction) of a user. Lighting apparatus 1 may be disposed slightly above the eye level, and installed on a wall, a ceiling, or the like in which a window is not installed, or cannot be installed. In this manner, by providing lighting apparatus 1, a user feels as if viewing the actual blue sky through the window.

[Advantageous Effect]

Next, an advantageous effect of lighting apparatus 1 according to the present embodiment will be described.

As described above, lighting apparatus 1 according to the present embodiment includes: a light source; reflector plate 4 which reflects light; and diffuser plate 5 which is light transmissive and is disposed to face reflector plate 4. A gap between diffuser plate 5 and reflector plate 4 gradually decreases from a lower portion side of diffuser plate 5 and reflector plate 4 to an upper potion side of diffuser plate 5 and reflector plate 4. The light source is disposed on the lower portion side to emit light toward diffuser plate 5 and reflector plate 4.

According to this configuration, the luminance level of light emitted from diffuser plate 5 increases with decreasing distance from the light source, and decreases with increasing distance from the light source. Accordingly, light having luminance gradient exits through diffuser plate 5. For that reason, when lighting apparatus 1 is viewed, the viewer perceives, through light-transmissive plate 35, luminance gradient similar to the actual sky.

In addition, since the light source, reflector plate 4, and diffuser plate 5 are used, light is repeatedly diffused and reflected, making it possible to emit light which provides a sense of depth from diffuser plate 5. It is thus possible to simplify the configuration of lighting apparatus 1.

Thus, according to lighting apparatus 1, it is possible to reproduce an artificial sky with a simple configuration.

By installing lighting apparatus 1 in a facility (location) etc., where natural lighting is difficult to obtain, it is possible to implement a lighting environment similar to the lighting environment in nature.

In addition, in lighting apparatus 1 according to the present embodiment, the light source emits light of different luminescent colors.

According to this configuration, diffuser plate 5 looks like gradation in which the color temperature or the luminance level of light gradually changes according to a distance from the light source.

In addition, in lighting apparatus 1 according to the present embodiment, the light source includes white light source 61 which emits white light and blue light source 62 which emits blue light.

According to this configuration, diffuser plate 5 looks like gradation in which light gradually changes from white light to blue light with increasing distance from the light source.

In addition, lighting apparatus 1 according to the present embodiment further includes: frame body 32 which has a plate-like shape and includes opening portion 33 through which light exiting through diffuser plate 5 passes. Frame body 32 is disposed to cover an outer periphery of diffuser plate 5 in a front view of opening portion 33.

According to this configuration, frame body 32 is disposed to cover the outer periphery of diffuser plate 5 in a front view of opening potion 33, and thus the upper-side, lower-side, left-side, and right-side walls of main body 31 are difficult to visually recognize via opening portion 33.

In particular, even when diffuser plate 5 is slanted as in the present embodiment, the right and left sides of main body 31 are difficult to visually recognize via light-transmissive plate 35 of opening portion 33 when lighting apparatus 1 is viewed in a front view, and thus it is difficult to recognize that diffuser plate 5 is slanted. For that reason, the sense of depth is maintained.

In particular, luminance unevenness and color unevenness are difficult to visually recognize even when a plurality of LED chips, white light sources 61 and color light sources 62, are arranged as in the present embodiment. For that reason, it is possible to provide an open feeling and sensation as if viewing the actual sky through light-transmissive plate 35.

In addition, in lighting apparatus 1 according to the present embodiment, frame body 32 has an inner surface having a black color that suppresses reflection of light.

According to this configuration, light incident on the back surface of frame body 32 is absorbed. For that reason, it is difficult for light reflected by the back surface of frame body 32 and incident on diffuser plate 5 to be further reflected and exit through light-transmissive plate 35. For that reason, frame body 32 is not likely to be reflected on diffuser plate 5. For that reason, the open feeling and sensation as if viewing the actual sky through light-transmissive plate 35 are maintained.

In addition, in lighting apparatus 1 according to the present embodiment, opening portion 33 has an inner circumference surface having a black color that suppresses reflection of light.

According to this configuration as well, light which is incident on the inner circumference surface of opening portion 33 is absorbed. For that reason, it is difficult for light reflected by the inner circumference surface of opening portion 33 and incident on diffuser plate 5 to be further reflected and exit through light-transmissive plate 35. Accordingly, the inner circumference surface of opening portion 33 is not likely to be reflected on diffuser plate 5. For that reason, the open feeling and sensation as if viewing the actual sky through light-transmissive plate 35 are maintained.

In addition, lighting apparatus 1 according to the present embodiment further includes light-transmissive plate 35 disposed to cover opening portion 33 of frame body 32. In addition, diffuser plate 5 includes a surface (front surface) which faces opening portion 33 and is covered by an antireflection film that prevents reflection of light, and light-transmissive plate 35 includes a surface (back surface) which faces diffuser plate 5 and is covered by an antireflection film that prevents reflection of light.

According to this configuration, the antireflection film covers the back surface of light-transmissive plate 35, and thus it is difficult for light which is incident on the back surface of light-transmissive plate 35 to be reflected and travel to diffuser plate 5. In addition, since the antireflection film covers the front surface of diffuser plate 5, it is difficult for light which is incident on the front surface of diffuser plate 5 to be reflected and exit through light-transmissive plate 35. For the reasons stated above, lighting apparatus 1 is capable of providing an open feeling and sensation as if viewing the actual sky through light-transmissive plate 35.

In addition, lighting apparatus 1 according to the present embodiment further includes eaves portion 7 disposed on the upper portion side of diffuser plate 5 and reflector plate 4, on a light-exit side with respect to a surface of diffuser plate 5 through which light exits. Eaves portion 7 has a surface on a lower portion side (light source side) having a black color that suppresses reflection of light.

According to this configuration, since eaves portion 7 is seen through light-transmissive plate 35, a user feels as if the actual sky extends far away from eaves portion 7 (feels infinite depth). In addition, light which is incident on the lower side of eaves portion 7 is absorbed by eaves portion 7, and thus it is difficult for light reflected by eaves portion 7 to be reflected on diffuser plate 5. For that reason, it is possible to provide a sense of distance between light-transmissive plate 35 and diffuser plate 5. As a result, it is possible to provide an open feeling and sensation as if viewing the actual sky through light-transmissive plate 35.

In addition, in lighting apparatus 1 according to the present embodiment, reflector plate 4 is disposed substantially parallel with optical axis X of the light source.

According to this configuration, when lighting apparatus 1 is viewed in a front view or from below, the light source is not likely to be reflected on reflector plate 4. For that reason, it is possible to provide an open feeling and sensation as if viewing the actual sky through light-transmissive plate 35.

In addition, in lighting apparatus 1 according to the present embodiment, diffuser plate 5 is flat, and is disposed at a predetermined angle θ to reflector plate 4, and the predetermined angle θ is in a range from 2 degrees or greater to 10 degrees or less.

According to this configuration, the predetermined angle θ is in a range from 2 degrees or greater to 10 degrees or less. Accordingly, the thickness in the forward and backward direction of lighting apparatus 1 is not likely to be large. The light source is difficult to visually recognize through diffuser plate when the predetermined angle θ is too small, and light is difficult to be incident between diffuser plate 5 and reflector plate 4 when the predetermined angle θ is too large. For that reason, it is possible to provide an open feeling and sensation as if viewing the actual sky through light-transmissive plate 35, by setting an appropriate angle for diffuser plate 5 and reflector 4.

In particular, since the predetermined angle θ is in a range from 2 degrees or greater to 10 degrees or less, the thickness of lighting apparatus 1 is not likely to be large even when lighting apparatus 1 is increased in size. For that reason, with lighting apparatus 1, for example, installation work such as hanging on a wall or embedding in a wall is easily performed.

In particular, with a configuration in which a distance between reflector plate 4 and optical axis X gradually decreases from the lower side to the upper side of reflector plate 4, when a lighting apparatus other than lighting apparatus 1 is present, there is a possibility that light emitted from the lighting apparatus other than lighting apparatus 1 is reflected on reflector plate 4. However, with a configuration in which reflector plate 4 is disposed substantially vertical and diffuser plate 5 is slanted at the predetermined angle θ to reflector plate 4, even when light emitted from the lighting apparatus other than lighting apparatus 1 is reflected on reflector plate 4, it is not likely to cause a user to have a feeling of strangeness.

In addition, in lighting apparatus 1 according to the present embodiment, less than or equal to 50% of light reflected by reflector plate 4 is diffusely reflected. In addition, in lighting apparatus 1 according to the present embodiment, reflector plate 4 is a mirror which reflects incident light.

According to the above-described configuration, a portion of incident light is specularly reflected, another portion of light is diffused, and the rest of light is absorbed. For that reason, the luminance level of light which exits through diffuser plate 5 decreases with increasing distance from the light source. For that reason, it is possible for a user to feel the color and the luminance gradient which are similar to the actual sky. In other words, it is possible to provide a user with a sense of depth.

The color temperature of light which exits through diffuser plate 5 gradually changes in such a manner that the light changes from white light to blue light with increasing distance from the light source, by using white light source 61 and blue light source 62 as in the present embodiment. In this case as well, it is possible for a user to feel a color and a luminance gradient which are similar to the actual sky.

In addition, in lighting apparatus 1 according to the present embodiment, reflector plate 4 may have a wavelength-selective property of absorbing light having a wavelength in a range from 610 nm or greater to 750 nm or less, and reflecting light having a wavelength in a range from 435 nm or greater to 495 nm or less.

According to this configuration, reflector plate 4 absorbs red light included in white light, and thus it is possible to prevent red light from exiting through diffuser plate 5. For that reason, it is possible to reproduce a blue sky more similar to the actual blue sky.

In addition, in lighting apparatus 1 according to the present embodiment, diffuser plate 4 may be a Rayleigh diffuser plate which causes Rayleigh scattering of incident light.

According to this configuration, red light included in white light is difficult to diffuse by diffuser plate 5 and blue light is diffused by diffuser plate 5, and thus pale blue light exits through the front surface of diffuser plate 5. For that reason, it is possible to reproduce an artificial blue sky by using the Rayleigh diffuser plate. In particular, since the number of blue light sources 62 can be reduced in this case, it is possible to reduce the manufacturing costs.

Embodiment 2

(Configuration)

Figure 5:
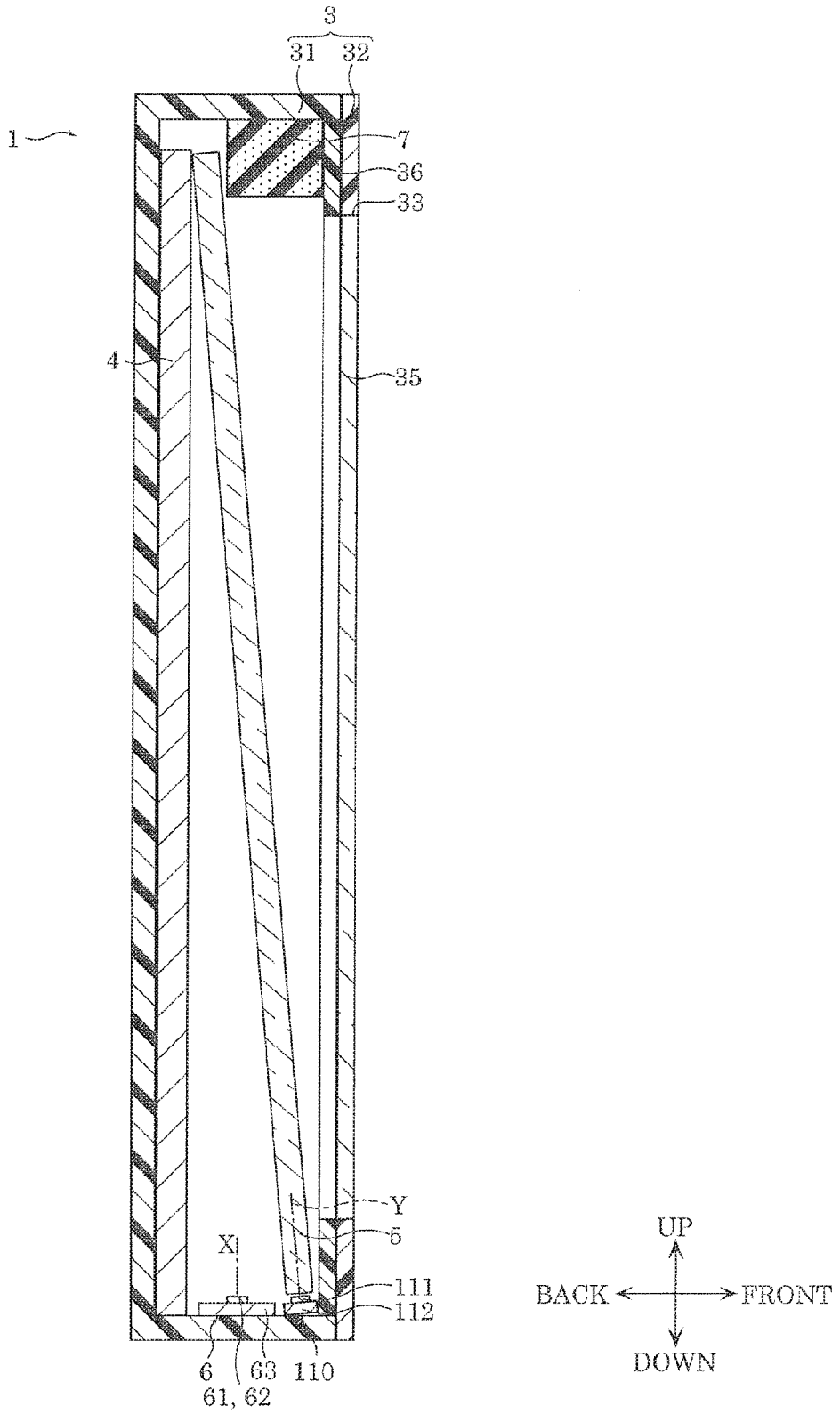
FIG. 5 is a cross-sectional view which illustrates the lighting apparatus along the line II-II of FIG. 1, according to Embodiment 2.
Figure 6:
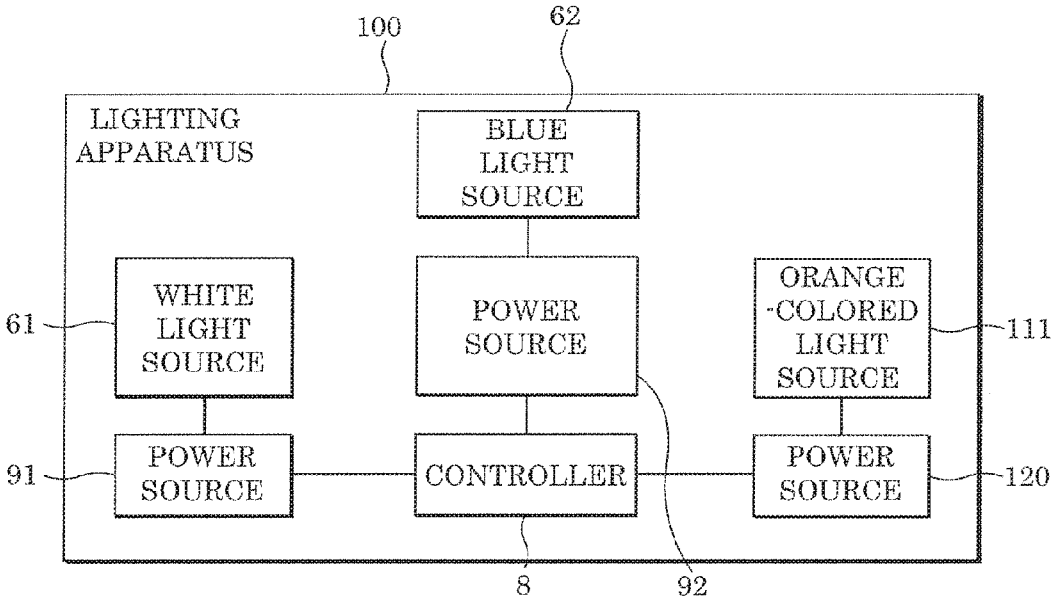
FIG. 6 is a block diagram which the illustrates the lighting apparatus according to Embodiment 2.

The following describes a configuration of lighting apparatus 100 according to Embodiment 2, with reference to FIG. 5 and FIG. 6.

FIG. 5 is a cross-sectional view which illustrates lighting apparatus 100 along the line II-II of FIG. 1, according to Embodiment 2. FIG. 6 is a block diagram which illustrates lighting apparatus 100 according to Embodiment 2.

Embodiment 2 is different from Embodiment 1 in that orange light source 111 and power source 120 are included in addition to the configuration according to Embodiment 1. Furthermore, lighting apparatus 100 according to Embodiment 2 is similar to lighting apparatus 100 according to Embodiment 1, the same structural components are assigned with the same reference signs, and detailed descriptions for the structural components will be omitted.

As illustrated in FIG. 5 and FIG. 6, lighting apparatus 100 further includes second light emitting module 110.

Second light emitting module 100 is a module including a plurality of orange light sources 111, and circuit board 112 on which the plurality of orange light sources 111 are mounted, and is housed in casing 3. Second light emitting module 110 is disposed between main body 31 and diffuser plate 5 on a lower portion side of diffuser plate 5, and has a plate-like shape which is elongated in the right and left direction. Second light emitting module 110 is different from first light emitting module 6 only in a wavelength component of emitted light, and may be similar to first light emitting module 6. It should be noted that, in the present embodiment, the light source refers to the plurality of white light sources 61, the plurality of blue light sources 62, and the plurality of orange light sources 111.

The plurality of orange light sources 111 are disposed at substantially regular intervals along the length (the right and left directions) of circuit board 112 in a line in the right and left directions. Each of the plurality of orange light sources 111 emits orange light. Each of the plurality of orange light sources 111 is disposed in such a manner that optical axis Y is substantially parallel with diffuser plate 5 such that light enters from the lower end face (one of end faces) of diffuser plate 5. According to the present embodiment, second light emitting module 110 is fixed in a slanted state in casing 3 in such a manner that second light emitting module 110 is slanted downward from the front side to the back side.

It should be noted that the plurality of orange light sources 111 may be mounted on first light emitting module 6. The plurality of orange light sources 111 may also be disposed on first light emitting module 6 in such a manner that optical axis X of the light source is sandwiched between reflector plate 4 and diffuser plate 5. Accordingly, the plurality of orange light sources 111 may be disposed to emit light toward diffuser plate 5 and reflector plate 4 as in the plurality of white light sources 61 and the plurality of blue light sources 62. In other words, unlike second light emitting module 110, lighting apparatus 1 need not be of the edge light type.

It should be noted that the plurality of white light sources 61 and the plurality of blue light sources 62 may be mounted on second light emitting module 110. The plurality of white light sources 61 and the plurality of blue light sources 62 may also be disposed substantially parallel with diffuser plate 5 such that the plurality of orange light sources 111 causes light to enter from the lower end face (one of end faces) of diffuser plate 5.

Power source 120 includes a power supply circuit which generates power for causing second light emitting module 110 to emit light, and supplies DC power to second light emitting module 110. The configuration of power source 120 is substantially the same as the configurations of the two power sources 91 and 92 according to Embodiment 1.

With lighting apparatus 100 as described above, for example, the output of white light source 61 is set at approximately the middle level, and the output of blue light sources 62 is set at a level greater than approximately the middle level, in first light emitting module 6. Furthermore, the output of orange light source 111 is set at zero in second light emitting module 110. In this case, bright white light exits through diffuser plate 5 from the side close to first light emitting module 6, and blue light which gradually increases the brightness exits through diffuser plate 5 with increasing distance from first light emitting module 6. In other words, light having a gradation that changes gradually from white light to blue light from the lower side toward the upper side of diffuser plate 5 exits through diffuser plate 5, and thus it looks as if the actual sky extends far away from light-transmissive plate 35.

In addition, with lighting apparatus 100 as described above, for example, the output of white light source 61 is set at approximately the middle level, and the output of blue light sources 62 is set at a level less than approximately the middle level, in first light emitting module 6. Furthermore, the output of orange light source 111 is set at zero in second light emitting module 110. In this case, bright white light exits through diffuser plate 5 from the side close to first light emitting module 6, and white light which gradually decreases in the brightness exits through diffuser plate 5 with increasing distance from first light emitting module 6. In other words, light having a gradation that gradually decreases in the brightness (decreases in the luminance level) from the lower side toward the upper side of diffuser plate 5 exits through diffuser plate 5, and thus it looks as if the actual cloudy sky extends far away from light-transmissive plate 35.

In addition, with lighting apparatus 100 as described above, for example, the output of orange light source 111 is set at approximately the middle level in second light emitting module 110, and the output of each of white light source 61 and blue light source 62 is set at a level less than approximately the middle level in first light emitting module 6. In this case, bright orange light exits through diffuser plate 5 from the side close to second light emitting module 110, and blue light which gradually decreases in the brightness exits through diffuser plate 5 with increasing distance from second light emitting module 110. In other words, light having a gradation that changes gradually from orange light to blue light and also gradually decreases in the brightness from the lower side toward the upper side of diffuser plate 5 exits through diffuser plate 5, and thus it looks as if the actual sunset extends far away from light-transmissive plate 35.

In addition, with lighting apparatus 100 as described above, for example, the output of white light source 61 is set at zero or approximately zero, and the output of blue light sources 62 is set at a level less than approximately the middle level, in first light emitting module 6. Furthermore, the output of orange light source 111 is set at zero or approximately zero in second light emitting module 110. In this case, dark blue light exits through diffuser plate 5 from the side close to first light emitting module 6, and light is less and less emitted with increasing distance from first light emitting module 6. In other words, light having a gradation that gradually decreases in the brightness (decreases in the luminance level) from the lower side toward the upper side of diffuser plate 5 exits through diffuser plate 5, and thus it looks as if the state of night is presented and the actual evening state extends far away from light-transmissive plate 35.

In this manner, it is possible to reproduce various states of the sky such as the blue sky, the cloudy sky, sunset, evening, etc., by controlling white light source 61, blue light source 62, and orange light source 111 using lighting apparatus 100.

[Advantageous Effect]

Next, an advantageous effect of lighting apparatus 100 according to the present embodiment will be described.

As described above, in lighting apparatus 100 according to the present embodiment, the light source further includes orange light source 111 which emits orange light.

According to this configuration, it is possible to simulatively reproduce the state of sunset on diffuser plate 5. In particular, it is possible to reproduce various states of the sky such as the blue sky, the cloudy sky, sunset, evening, etc., by combining white light source 61 and blue light source 62 with orange light source 111.

The present embodiment produces other advantageous effects in the same manner as Embodiment 1.

(Other Modifications, Etc.)

Although the lighting apparatus according to the present disclosure has been described on the basis of Embodiments 1 and 2, the present disclosure is not limited to the above-described Embodiments 1 and 2.

Figure 7:
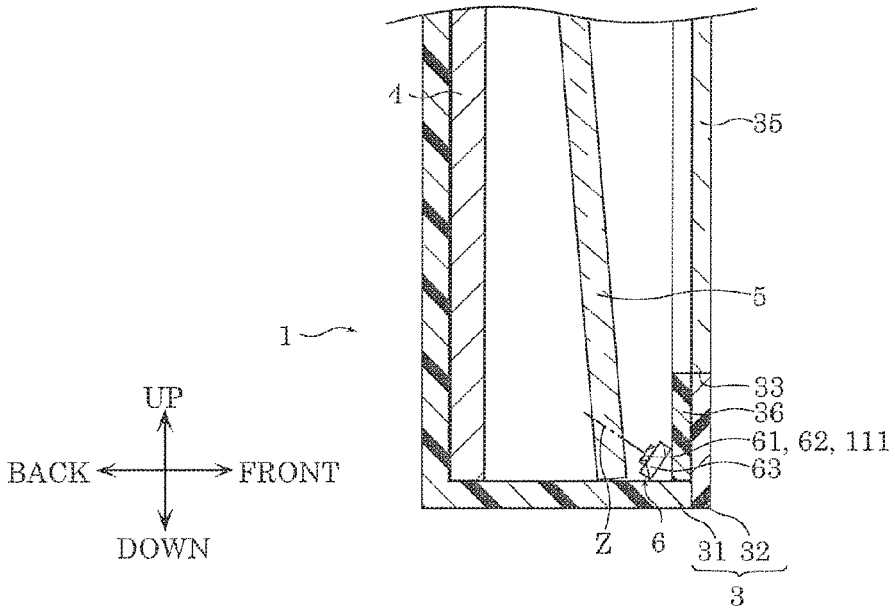
FIG. 7 is a cross-sectional view which illustrates a portion of the lighting apparatus along the line II-II of FIG. 1, according to a modification example.

FIG. 7 is a cross-sectional view which illustrates a portion of lighting apparatus 1 along the line II-II of FIG. 1, according to a modification example. For example, in the foregoing embodiments, first light emitting module 6 may include a plurality of white light sources 61, a plurality of blue light sources 62, and a plurality of orange light sources 111. First light emitting module 6 may be disposed on the lower end side of main body 31 in front of diffuser plate 5 in such a manner that optical axis Z of the light source (the plurality of white light sources 61, the plurality of blue light sources 62, and the plurality of orange light sources 111) faces the lower portion side of diffuser plate 5 and the lower side of reflector plate 4. As illustrated in FIG. 7, optical axis Z of the light source may be oriented in order of alignment of diffuser plate 5 and reflector plate 4. In other words, first light emitting module 6 is, for example, disposed on a lower portion side of diffuser plate 5 and reflector plate 4 to emit light toward diffuser plate 5 and reflector plate 4. Here, the lower edge portion side of diffuser plate 5 is the incident surface. With this configuration as well, it is possible to reproduce various states of the sky such as the blue sky, the cloudy sky, sunset, evening, etc.

In addition, although the diffuser plate is slanted toward the reflector plate according to the foregoing embodiments, the reflector plate may be slanted toward the diffuser plate. Furthermore, each of the diffuser plate and the reflector plate may be flat or has a curved shape. In other words, the gap between the diffuser plate and the reflector plate only need to be gradually narrowed from one end to the other end.

In addition, in the foregoing embodiments, an upper end side (one end portion) of diffuser plate 5 may abut on (be in contact with) an upper end side of reflector plate 4 to prevent leakage of light emitted by white light source 61 and blue light source 62 from the gap between diffuser plate 5 and reflector plate 4.

In addition, in the foregoing embodiments, the controller may have a timer function. In addition, the controller may have, for example, a lighting mode for switching between the blue sky, the sunset, the cloudy sky, the evening sky, etc., at a predetermined time (when a predetermined period of time passes), using the timer function. More specifically, for example, switching may be carried out in the lighting mode such that, when a predetermined period of time passes after light for reproducing the artificial blue sky is emitted, light for reproducing the sunset sky is emitted and light for reproducing the evening sky or the like is emitted. In addition, the lighting apparatus may be automatically turned off when a predetermined period of time passes. In this case, lighting changes at a predetermined time according to the timer function and the lighting mode, and thus it is possible to implement the lighting environment as if there is a window. Such settings may be performed using an operation component such as a remote controller, which is not illustrated.

In addition, although the lighting apparatus has a rectangular shape in a front view (when viewed from the front side) in the foregoing embodiments, the shape is not limited to the rectangular shape. For example, a multiangular shape such as a triangular shape, or a half-moon shape may be employed, or a combination of these shapes may be employed.

In addition, in the foregoing embodiments, the diffuser plate may be movable such that the predetermined angle with respect to the reflector plate is variable. More specifically when the predetermined angle increases, the lower end side of the diffuser plate moves forward and the upper end side of the diffuser plate moves downward with respect to the reflector plate. On the other hand, when the predetermined angle decreases, the lower end side of the diffuser plate moves backward and the upper end side of the diffuser plate moves upward with respect to the reflector plate. In this case, it is possible to change the predetermined angle between the diffuser plate and the reflector plate, as necessary, to be suitable to a location in which the lighting apparatus is installed. It is possible to move the diffuser plate using a driving system such as a motor.

In addition, in the foregoing embodiments, a diffusion cover (straight-tube LED lamp) which covers the light source may be provided. In this case, comparing to the case where light is emitted from a plurality of LED chips which are simply arranged, luminance unevenness and color unevenness are not likely to occur on the diffuser plate in proximity to the light source.

In addition, in the foregoing embodiments, the light absorbing sheet may be disposed on the bottom surface, the right side surface, and the left side surface of the casing, as being black in color that suppresses reflection of light, and the light absorbing sheet may be disposed on the bottom surface, the right side surface, and the left side surface of the casing.

In addition, in the foregoing embodiments, although an operation component is electrically connected to the lighting apparatus, a remote controller which performs radio communications may operate the lighting apparatus (operation such as turning on or off of the power sources). The radio communications can be achieved by providing the lighting apparatus with a communicator which performs the radio communications with the remote controller. The communicator is, for example, a device having the near field communication function, such as ZigBee (registered trademark), Wi-Fi (registered trademark), and Bluetooth (registered trademark).

It should be noted that the present disclosure also includes other forms in which various modifications apparent to those skilled in the art are applied to Embodiments 1 and 2 or forms in which structural components and functions in Embodiments 1 and 2 are arbitrarily combined within the scope of the present disclosure.

While the foregoing has described one or more embodiments and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A lighting apparatus, comprising:

a light source;

a reflector plate which reflects light;

a diffuser plate which is light transmissive and is disposed to face the reflector plate;

a plate-shaped frame including an opening through which light exiting through the diffuser plate passes;

a light-transmissive plate that covers the opening of the frame, wherein:

the frame covers an outer periphery of the diffuser plate in a front view of the opening, a gap between the diffuser plate and the reflector plate gradually decreases from one end side of the diffuser plate and the reflector plate to an other end side of the diffuser plate and the reflector plate, the light source is disposed on the one end side to emit light toward the diffuser plate and the reflector plate, the diffuser plate includes a surface which faces the opening and is covered by an antireflection film that prevents reflection of light, and the light-transmissive plate includes a surface which faces the diffuser plate and is covered by an antireflection film that prevents reflection of light.

2. The lighting apparatus according to claim 1, wherein the frame has an inner surface having a black color that suppresses reflection of light.

3. The lighting apparatus according to claim 1, wherein the opening has an inner circumference surface having a black color that suppresses reflection of light.

4. A lighting apparatus comprising:

a light source;

a reflector plate which reflects light;

a diffuser plate which is light transmissive and is disposed to face the reflector plate; and eaves disposed on the other end side of the diffuser plate and the reflector plate, on a light-exit side with respect to a surface of the diffuser plate through which light exits, wherein:

a gap between the diffuser plate and the reflector plate gradually decreases from one end side of the diffuser plate and the reflector plate to another end side of the diffuser plate and the reflector plate, the light source is disposed on the one end side to emit light toward the diffuser plate and the reflector plate, and the eaves have a surface on a light source side, the surface having a black color that suppresses reflection of light.

5. The lighting apparatus according to claim 4, wherein the light source emits light of different luminescent colors.

6. The lighting apparatus according to claim 5,
wherein the light source includes a white light source which emits white light and a blue light source which emits blue light.

7. The lighting apparatus according to claim 4,
wherein the light source further includes an orange light source which emits orange light.

8. The lighting apparatus according to claim 4,
wherein the reflector plate is disposed substantially parallel with an optical axis of the light source.

9. The lighting apparatus according to claim 4,
wherein the diffuser plate is flat, and is disposed at a predetermined angle to the reflector plate, and
the predetermined angle is in a range from 2 degrees or greater to 10 degrees or less.

10. The lighting apparatus according to claim 4,
wherein less than or equal to 50% of light reflected by the reflector plate is diffusely reflected.

11. The lighting apparatus according to claim 4,
wherein the reflector plate is a mirror which reflects incident light.

12. The lighting apparatus according to claim 4,
wherein the reflector plate has a wavelength-selective property of absorbing light having a wavelength in a range from 610 nm or greater to 750 nm or less, and reflecting light having a wavelength in a range from 435 nm or greater to 495 nm or less.

13. The lighting apparatus according to claim 4,
wherein the diffuser plate is a Rayleigh diffuser plate which causes Rayleigh scattering of incident light.

* * * * *